United States Patent [19]

Hoch

[11] Patent Number: 4,531,574

[45] Date of Patent: Jul. 30, 1985

[54] MOUNTING CONNECTING AN OIL COOLER TO A RADIATOR

[75] Inventor: John J. Hoch, Beaver Dam, Wis.

[73] Assignee: Deere & Company, Moline, Ill.

[21] Appl. No.: 453,636

[22] Filed: Dec. 27, 1982

[51] Int. Cl.[3] ..... F28F 9/00; F28F 7/00

[52] U.S. Cl. ..... 165/67; 165/41; 165/76; 165/DIG. 23; 248/201; 248/232; 403/329; 403/330; 180/68.4; 123/41.33; 123/41.43; 123/195 A

[58] Field of Search ..... 165/67, 41, 134 R, 76, 165/82, 77; 180/68; 123/41.33, 41.51, 195 A, 196 AB, 41.43; 248/201, 232, 233, 632, 634, 240.4, 221.3, 221.4; 403/329, 330

[56] References Cited

U.S. PATENT DOCUMENTS

| | | | |
|---|---|---|---|
| 1,015,474 | 1/1912 | Bullock | 165/134 R |
| 1,507,964 | 9/1924 | Hudson | 165/77 |
| 2,524,798 | 10/1950 | Hoskinson | 123/196 AB |
| 2,559,099 | 7/1951 | West | 248/221.3 |
| 3,008,692 | 11/1961 | Gerard | 165/67 |
| 3,123,170 | 3/1964 | Bryant | 248/232 |
| 3,297,080 | 1/1967 | Williams et al. | 165/77 |
| 4,196,774 | 4/1980 | Hoffmann | 165/67 |

*Primary Examiner*—Albert W. Davis, Jr.
*Assistant Examiner*—John K. Ford

[57] ABSTRACT

An oil cooler is mounted to a radiator so as to be in series therewith. The oil cooler is provided with a framework having four holes therein arranged in a rectangular pattern. In one embodiment, the holes are transverse, with a lower pair being axially aligned, and in another embodiment the holes are vertical, with the pairs of holes at the opposite transverse sides being vertically aligned. Mounted on the radiator are four spring metal straps which respectively carry pins received in an associated hole. In the one embodiment, removal of the upper pair of pins permits the cooler to pivot about the lower pair while, in the other embodiment, removal of the pair of pins at one side of the cooler will permit the cooler to pivot about the pins at the other side.

9 Claims, 2 Drawing Figures

MOUNTING CONNECTING AN OIL COOLER TO A RADIATOR

BACKGROUND OF THE INVENTION

The present invention relates to air-cooled heat exchangers used on vehicles, such as tractors or the like, and more specifically relates to mountings for attaching an oil cooler to a radiator so as to be in series therewith in a path followed by coolant air.

Mountings for attaching an oil cooler to a radiator are known which permit the oil cooler to be slid (see U.S. Pat. No. 3,757,853 issued to Daman on Sept. 11, 1973) or pivoted (see U.S. Pat. No. 3,334,704 issued to Gehrke et al on Aug. 8, 1967) relative to the radiator so as to make the oil cooler more accessible for cleaning or service or to make the oil cooler easier to replace.

These mountings are not entirely satisfactory since they require the removal of screw fasteners before the oil coolers can be moved relative to the radiators to which they are attached. Such removal requires the use of tools and the removed fasteners may be dropped and lost or misplaced.

SUMMARY OF THE INVENTION

According to the present invention there is provided an improved mounting for releasably attaching an oil cooler to a radiator.

It is an object of the present invention to provide a mounting for releasably securing an oil cooler to a radiator without the use of removable screw fasteners and such that no tools are required.

Yet another object is to provide a mounting, as aforedescribed, having first portions which define a pivot axis about which the cooler may be swung when second portions of the mountings are released.

These and possibly other objects are accomplished by a mounting including upper and lower pairs of mounting holes provided at transversely spaced locations in a frame of the oil cooler and a spring metal strap fixed to the radiator adjacent each hole and carrying a pin which is received in the hole. In a first embodiment, the lower pair of mounting holes are transverse and axially aligned with each other so as to define a horizontal pivot axis about which the oil cooler may be swung upon releasing the mounting pins from the upper pair of mounting holes. In another embodiment, the mounting holes are vertical with the pair at each side of the oil cooler being axially aligned thereby establishing vertical pivot axes. Thus, by removing the pair of pins at one side of the oil cooler, the oil cooler may be swung about the vertical axis established by the pair of pins and holes at the other side of the oil cooler.

The embodiments of the invention will now be described by way of example only with reference to the accompanying drawing.

DESCRIPTION OF THE PREFERRED EMBODIMENT

Figure 1:
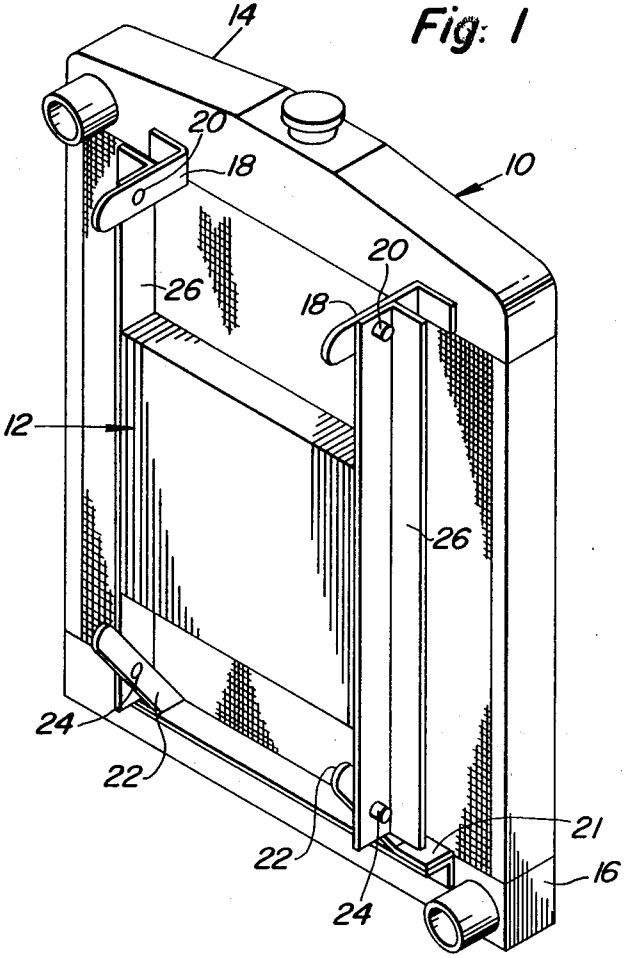
FIG. 1 is a perspective view of an oil cooler mounted to a radiator in accordance with the present invention with the mounting being arranged to selectively permit movement of the oil cooler about a horizontal axis.

Referring now to FIG. 1, therein is shown a radiator 10 having an oil cooler 12 releasably mounted thereon. Specifically, the radiator 10 is provided with upper and lower transverse frame members 14 and 16. Cantilevered from the member 14 is a pair of spring metal straps 18. Specifically, the straps 18 are L-shaped and fixed to one face of the member 14 at transversely spaced locations therealong are respective shorter legs of the pair of straps 18. The straps 18 are disposed with their short legs extending transversely. Each of the straps 18 has a pin 20 fixed to its long leg, intermediate the length thereof, such that the pins 20 extend transversely opposite from each other and are axially aligned with each other. The member 16 includes an angle member 21 extending the length thereof. Cantilevered from a horizontal leg of the angle member 21 are a pair of spring metal straps 22. Specifically, the straps 22 include shorter legs fixed to the member 21 and have respective longer legs extending upwardly and outwardly from the angle member and having respective pins 24 fixed thereto at locations intermediate the length thereof. These pins 24 are also in transverse, axial alignment with each other.

The oil cooler 12 has a mounting frame defined by a pair of vertically extending angle members 26 respectively fixed to opposite transversely spaced sides of the oil cooler. The angle members 26 are each provided with an upper mounting hole having one of the pins 20 received therein and a lower mounting hole having one of the pins 24 received therein. The cantilevered portions of the straps 18 and 22 each extend beyond the frame members 26 of the oil cooler 12 and terminate in ends which are free of the frame member so as to be accessible for easy manipulation by a person's hands.

The oil cooler 12 may be moved away from the radiator 10 in order to clean debris from the confronting surfaces of the radiator and oil cooler by manually deflecting the straps 18 far enough to move the pins 20 from the holes and then pivoting the oil cooler about the horizontal, transverse axis defined by the pins 24 and the holes in which they are received.

Figure 2:
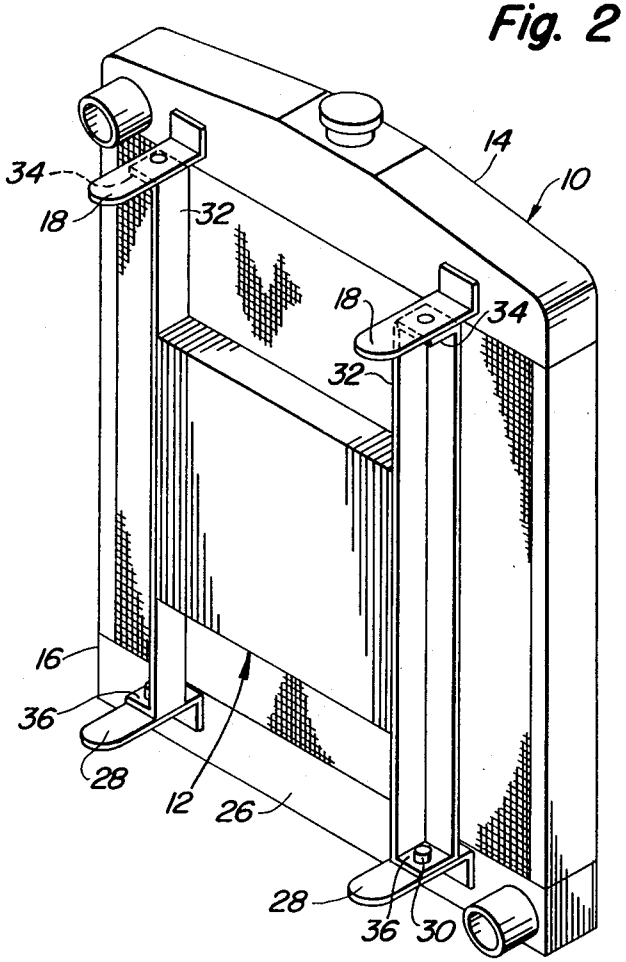
FIG. 2 is a view like FIG. 1, but with the mounting being arranged for permitting the oil cooler to be selectively swung about respective vertical axes at the opposite sides of the oil cooler.

Referring now to FIG. 2, it can be seen that the mounting for the oil cooler is like that described above except that the straps 18 have been rotated ninety degrees so that pins 20 project vertically. A similar pair of L-shaped straps 28 is fixed to the frame member 26 and carries pins 30 which are respectively vertically aligned with the pins 20 at each side of the oil cooler. The oil cooler has a pair of angle frame members 32 at its opposite lateral sides, and each frame member includes upper and lower horizontal mounting tabs 34 and 36. Vertically aligned holes are respectively provided in the tabs 34 and 36, with the upper pins 20 projecting downwardly through the holes in the tabs 34 and with the lower pins 30 projecting upwardly through the holes in the tabs 36. It will thus be appreciated that by releasing the pins 20 and 30 from their associated holes at one side of the oil cooler, the oil cooler is readied for swinging about a vertical pivot axis defined by the pins 20 and 30 at the other side of the oil cooler.

While the spring metal straps are herein shown as carrying the mounting pins, it will be appreciated that the pins could be fixed to the frame of the oil cooler with the holes then being in the spring metal straps.

I claim:

1. A mounting releasably securing an oil cooler to a radiator, comprising: a plurality of spaced apart spring metal mounting straps fixed to the radiator and including cantilevered portions projecting from the radiator in the direction of the oil cooler; each of the cantilevered portions of the mounting straps carrying a mounting pin intermediate its length and extending crosswise thereto; said oil cooler including a frame having a plurality of spaced holes therein respectively receiving one of the mounting pins; and each cantilevered portion extending beyond said frame and terminating in an end which is free of said frame, whereby the oil cooler may be disconnected from the radiator by removing the pins from the holes by grasping the free ends of and deflecting the mounting straps.

2. The mounting defined in claim 1 wherein at least two straps are located at one side of the oil cooler and the pins carried by said two straps and the holes in which they are received are axially aligned to thereby define a pivot axis about which the oil cooler may swing upon the pins carried by all straps other than said two straps being removed from the holes associated therewith.

3. The mounting defined in claim 2 wherein the two pins are adjacent a lower side of the oil cooler and are horizontally aligned.

4. The mounting defined in claim 2 wherein the two pins are adjacent a lateral side of the oil cooler and are vertically aligned.

5. The mounting defined in claim 1 wherein four mounting straps are fixed to the radiator in a rectangular configuration and are the total of the mounting straps used.

6. The mounting defined in claim 5 wherein the mounting straps are arranged such that the pins carried thereby are horizontal; and at least a lower pair of the pins being axially aligned with each other and cooperating with the mounting holes in which they are received to define a horizontal pivot about which the oil cooler is pivotable upon release of an upper pair of the pins from the mounting holes in which they are received.

7. The mounting defined in claim 5 wherein the mounting straps are arranged such that the pins carried thereby are vertical; and at least a pair of the pins at one side of the oil cooler being axially aligned with each other and cooperating with the mounting holes in which they are received to define a vertical pivot about which the oil cooler is pivotable upon release of a pair of the pins at another side of the oil cooler from the mounting holes in which they are received.

8. The mounting defined in claim 7 wherein the pins and mounting holes at said another side of the oil cooler are vertically aligned to thereby define a vertical pivot about which the oil cooler is pivotable upon release of the pair of pins at said one side of the oil cooler.

9. The mounting defined in claim 6 wherein the mounting straps are L-shaped and the frame of the oil cooler comprises a pair of angle members located at opposite lateral sides thereof and having respective flanges extending crosswise to the pins.

* * * * *